US010073391B2

(12) United States Patent
Onaka et al.

(10) Patent No.: US 10,073,391 B2
(45) Date of Patent: Sep. 11, 2018

(54) FIXING DEVICE

(71) Applicant: KONICA MINOLTA, INC., Chiyoda-ku, Tokyo (JP)

(72) Inventors: Hiromitsu Onaka, Toyokawa (JP); Toshihito Kobayashi, Akashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/474,309

(22) Filed: Mar. 30, 2017

(65) Prior Publication Data

US 2017/0285537 A1 Oct. 5, 2017

(30) Foreign Application Priority Data

Mar. 31, 2016 (JP) ..... 2016-072193

(51) Int. Cl.
*G03G 15/20* (2006.01)

(52) U.S. Cl.
CPC ... *G03G 15/206* (2013.01); *G03G 2215/2035* (2013.01)

(58) Field of Classification Search
CPC ..... G03G 15/206; G03G 15/2089; G03G 2215/2035
USPC ..... 399/329
See application file for complete search history.

(56) References Cited

U.S. PATENT DOCUMENTS

2009/0014942 A1* 1/2009 Okuno ..... G03G 15/2053 271/4.06
2013/0189007 A1* 7/2013 Ohtsu ..... G03G 15/206 399/329
2013/0195523 A1* 8/2013 Yamaji ..... G03G 15/2053 399/329
2015/0030362 A1* 1/2015 Bae ..... G03G 15/2085 399/329

FOREIGN PATENT DOCUMENTS

JP 2008164686 A 7/2008
JP 2010039338 A 2/2010

* cited by examiner

*Primary Examiner* — Sandra Brase
(74) *Attorney, Agent, or Firm* — Cantor Colburn LLP

(57) ABSTRACT

A fixing device for fixing a toner image onto a recording medium includes: an endless belt that is configured to be able to rotate; a pressure member that is in contact with an outer peripheral surface of the belt; and a sliding member that has a sliding surface in contact with an inner peripheral surface of the belt and is arranged to face the pressure member with the belt interposed between the sliding member and the pressure member, wherein a direction in which the belt rotating slides on the sliding surface is referred to as a direction of conveyance, a plurality of first grooves as well as a plurality of second grooves each allowing two of the plurality of first grooves adjacent to each other to communicate with each other are formed on the sliding surface, and the first grooves and the second grooves are formed in a non-grid pattern.

15 Claims, 8 Drawing Sheets

FIXING DEVICE

CROSS REFERENCE TO RELATED APPLICATIONS

The entire disclosure of Japanese Patent Application No. 2016-072193 filed on Mar. 31, 2016 including description, claims, drawings, and abstract are incorporated herein by reference in its entirety.

BACKGROUND OF THE INVENTION

Field of the Invention

The present invention relates to a fixing device.

Description of the Related Art

There is known a fixing device for fixing a toner image onto a recording medium by applying heat and pressure to the toner image. JP 2010-39338 A discloses a configuration in which a separating member that presses a fixing belt toward the outer periphery side has a contact surface in contact with the fixing belt, grooves are formed on the contact surface, and the spacing between the grooves on an upstream side in the direction of drive of the fixing belt is smaller than the spacing between the grooves on a downstream side in the direction of drive of the fixing belt. JP 2008-164686 A discloses a configuration in which grid-like protrusions are provided on a sliding surface of a sliding sheet that slides with respect to an inner peripheral surface of a fixing belt.

A sliding member provided on the inner periphery of an endless belt has a sliding surface in contact with the inner peripheral surface of the belt. In order to reduce sliding friction between the belt and the sliding member, a lubricant is retained on the sliding surface. The lubricant runs short on the upstream side of the sliding member when the lubricant is retained more on the downstream side by the conveying force of the belt being driven. The sliding friction on the upstream side of the sliding member is increased as a result. When the lubricant retained more on the downstream side leaks out of the sliding surface, the amount of lubricant retained in the sliding member as a whole is decreased to thus cause an increase in the sliding friction. Durability of the lubricating member is deteriorated as a result of the increase in the sliding friction.

SUMMARY OF THE INVENTION

An object of the present invention is to provide a fixing device capable of inhibiting the increase in the sliding friction caused by the shortage of the lubricant.

To achieve the abovementioned object, according to an aspect, a fixing device for fixing a toner image onto a recording medium, reflecting one aspect of the present invention comprises: an endless belt that is configured to be able to rotate; a pressure member that is in contact with an outer peripheral surface of the belt; and a sliding member that has a sliding surface in contact with an inner peripheral surface of the belt and is arranged to face the pressure member with the belt interposed between the sliding member and the pressure member. A direction in which the belt rotating at the time of conveying the recording medium slides on the sliding surface is referred to as a direction of conveyance. A plurality of first grooves each extending in a direction intersecting with the direction of conveyance as well as a plurality of second grooves each allowing two of the plurality of first grooves adjacent to each other to communicate with each other are formed on the sliding surface. The first grooves and the second grooves are formed in a non-grid pattern.

In the fixing device described above, at least one of a width of the second groove, a depth of the second groove and spacing between the second grooves preferably varies between a center and an edge of the sliding surface in an orthogonal direction orthogonal to the direction of conveyance.

In the fixing device described above, the second groove formed on the edge of the sliding surface in the orthogonal direction is preferably wider, deeper or has narrower spacing than the second groove formed at the center of the sliding surface in the orthogonal direction.

In the fixing device described above, the second groove is preferably formed in a non-linear shape.

In the fixing device described above, a position at which the second groove communicates with the first groove on an upstream side in the direction of conveyance and a position at which the second groove communicates with the first groove on a downstream side in the direction of conveyance are preferably shifted from each other in a direction in which the first groove extends.

In the fixing device described above, at least one of a width of the first groove, a depth of the first groove and spacing between the first grooves preferably varies between an upstream side and a downstream side in the direction of conveyance.

In the fixing device described above, the first groove formed on the downstream side of the direction of conveyance is preferably wider, deeper or has narrower spacing than the first groove formed on the upstream side of the direction of conveyance.

In the fixing device described above, the first groove is preferably formed on an edge of the sliding surface in the direction of conveyance at a center of the sliding surface in an orthogonal direction orthogonal to the direction of conveyance, and is preferably formed away from the edge of the sliding surface in the direction of conveyance on an edge of the sliding surface in the orthogonal direction.

In the fixing device described above, each of two ends of the first groove is preferably arranged at a position away from the edge of the sliding surface.

In the fixing device described above, the direction of conveyance preferably corresponds to a vertically upward direction.

In the fixing device described above, the belt can preferably move in both the direction of conveyance and a direction opposite to the direction of conveyance selectively with respect to the sliding surface.

The fixing device described above preferably further comprises a control unit that controls an operation of the fixing device. The control unit preferably moves the belt in the direction of conveyance at the time of conveying the recording medium and, after stopping conveyance of the recording medium, moves the belt in the opposite direction on the basis of conditions at the time of moving the belt in the direction of conveyance.

In the fixing device described above, each of the first groove and the second groove preferably has a width of 5 μm or larger and 500 μm or smaller and a depth of 50 μm or larger and 100 μm or smaller.

To achieve the abovementioned object, according to an aspect, a fixing device for fixing a toner image onto a recording medium, reflecting one aspect of the present invention comprises: an endless belt that is configured to be able to rotate; a pressure member that is in contact with an outer peripheral surface of the belt; and a sliding member that has a sliding surface in contact with an inner peripheral surface of the belt and is arranged to face the pressure member with the belt interposed between the sliding member and the pressure member. A direction in which the belt rotating at the time of conveying the recording medium slides on the sliding surface is referred to as a direction of conveyance, while a direction orthogonal to the direction of conveyance is referred to as an orthogonal direction. A plurality of grooves each extending in a direction intersecting with the direction of conveyance is formed on the sliding surface. The groove is formed on an edge of the sliding surface in the direction of conveyance at a center of the sliding surface in the orthogonal direction, and formed away from the edge of the sliding surface in the direction of conveyance on an edge of the sliding surface in the orthogonal direction.

To achieve the abovementioned object, according to an aspect, an image forming apparatus reflecting one aspect of the present invention comprises the fixing device described above.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
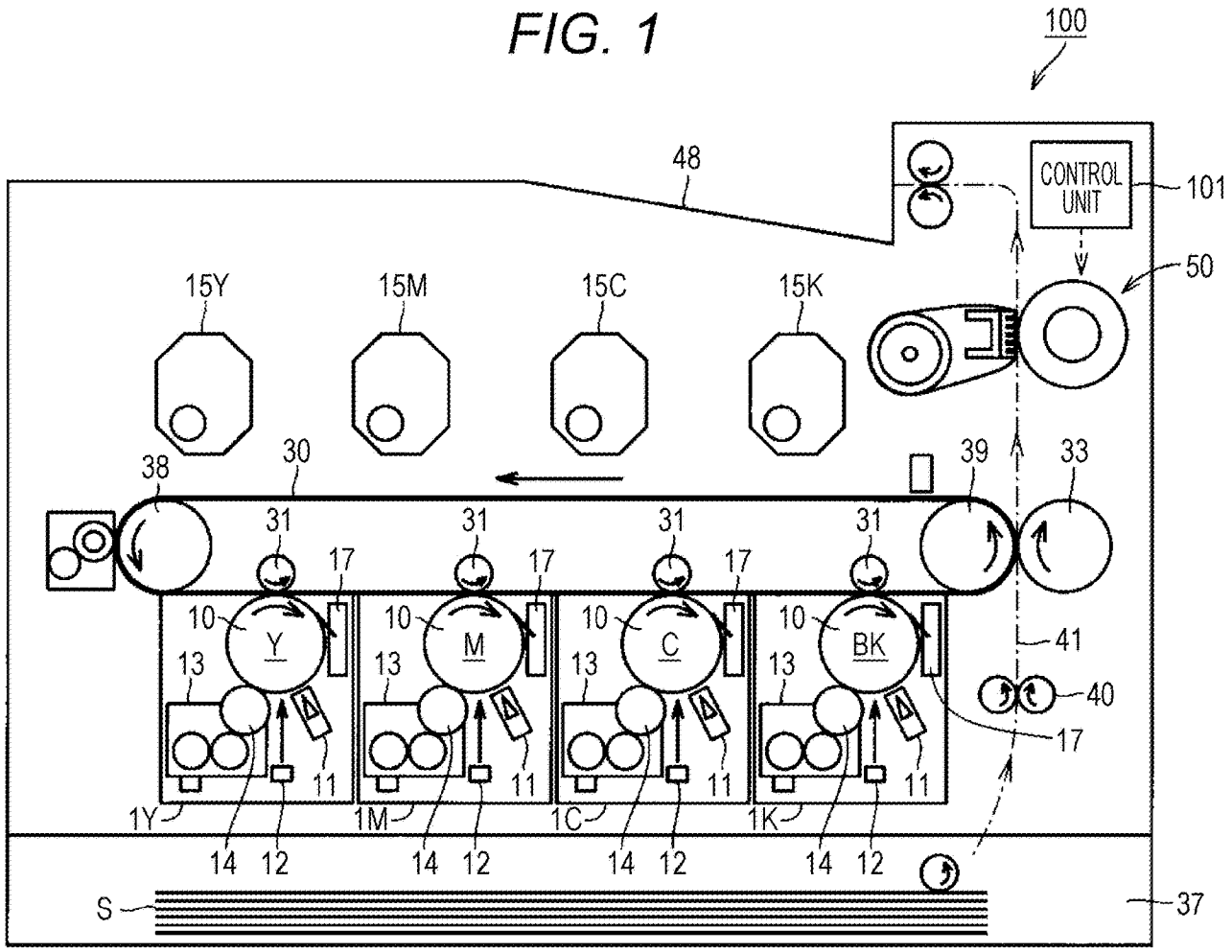
FIG. 1 is a diagram illustrating an example of an internal structure of an image forming apparatus according to a first embodiment.

Hereinafter, an embodiment of the present invention will be described with reference to the drawings. However, the scope of the invention is not limited to the illustrated examples. Identical parts and components are assigned identical reference numerals in the following description. Names and functions of those identical parts and components are also identical. Accordingly, detailed description of those parts and components will not be repeated. Note that embodiments and variations described hereinafter may be selectively combined as appropriate.

First Embodiment

[Internal Structure of Image Forming Apparatus 100]

FIG. 1 is a diagram illustrating an example of the internal structure of an image forming apparatus 100 according to a first embodiment. The image forming apparatus 100 equipped with a fixing device 50 according to the present invention will be described with reference to FIG. 1.

FIG. 1 illustrates the image forming apparatus 100 as a color printer. While the image forming apparatus 100 as the color printer will be described below, the image forming apparatus 100 is not limited to the color printer. The image forming apparatus 100 may be a monochrome printer, a facsimile machine, or a multi-functional peripheral (MFP) including the monochrome printer, the color printer and the facsimile machine, for example.

The image forming apparatus 100 includes image forming units 1Y, 1M, 1C, and 1K, an intermediate transfer belt 30, a primary transfer roller 31, a secondary transfer roller 33, a cassette 37, a driven roller 38, a driving roller 39, a timing roller 40, the fixing device 50, and a control unit 101.

The image forming units 1Y, 1M, 1C and 1K are arranged in this order along the intermediate transfer belt 30. The image forming unit 1Y forms a yellow (Y) toner image with toner supplied from a toner bottle 15Y. The image forming unit 1M forms a magenta (M) toner image with toner supplied from a toner bottle 15M. The image forming unit 1C forms a cyan (C) toner image with toner supplied from a toner bottle 15C. The image forming unit 1K forms a black (BK) toner image with toner supplied from a toner bottle 15K.

The image forming units 1Y, 1M, 1C, and 1K are arranged in order along the intermediate transfer belt 30 in the direction of rotation thereof. Each of the image forming units 1Y, 1M, 1C, and 1K includes a photoreceptor 10, a charging unit 11, an exposure unit 12, a developing unit 13, and a cleaning unit 17.

The charging unit 11 charges the surface of the photoreceptor 10 evenly. The exposure unit 12 irradiates the photoreceptor 10 with a laser beam in response to a control signal from the control unit 101 and exposes the surface of the photoreceptor 10 according to an image pattern being input. As a result, an electrostatic latent image corresponding to an input image is formed on the photoreceptor 10.

The developing unit 13 applies a developing bias to a developing roller 14 while rotating the developing roller 14 and causes the toner to adhere to the surface of the developing roller 14. As a result, the toner is transferred from the developing roller 14 to the photoreceptor 10, on the surface of which the toner image corresponding to the electrostatic latent image is developed.

The photoreceptor 10 and the intermediate transfer belt 30 are in contact with each other at a site where the primary transfer roller 31 is provided. The primary transfer roller 31 has the shape of a roller to be able to rotate. A transfer voltage opposite in polarity to the toner image is applied to the primary transfer roller 31, whereby the toner image is transferred from the photoreceptor 10 to the intermediate transfer belt 30. The yellow (Y) toner image, the magenta (M) toner image, the cyan (C) toner image and the black (BK) toner image are overlaid successively to be transferred from the photoreceptor 10 to the intermediate transfer belt 30. A color toner image is thus formed on the intermediate transfer belt 30.

The intermediate transfer belt 30 is stretched between the driven roller 38 and the driving roller 39. The driving roller 39 is driven by a motor (not shown) to rotate, for example. The intermediate transfer belt 30 and the driven roller 38 are rotated in conjunction with the driving roller 39. The toner image on the intermediate transfer belt 30 is thus conveyed to the secondary transfer roller 33.

The cleaning unit 17 is pressed against the photoreceptor 10. The cleaning unit 17 collects the toner remaining on the surface of the photoreceptor 10 after the toner image is transferred.

Sheets S as an example of a recording medium are set in the cassette 37. The sheets S are sent to the secondary transfer roller 33 along a conveyance path 41 by a timing roller 40 one sheet at a time from the cassette 37. The secondary transfer roller 33 has the shape of a roller to be able to rotate. The secondary transfer roller 33 applies the transfer voltage opposite in polarity to the toner image to the sheet S being conveyed. The toner image is thus attracted to the secondary transfer roller 33 from the intermediate transfer belt 30, so that the toner image on the intermediate transfer belt 30 is transferred to the sheet.

A timing for conveying the sheet S to the secondary transfer roller 33 is adjusted by the timing roller 40 according to the position of the toner image on the intermediate transfer belt 30. The timing roller 40 allows the toner image on the intermediate transfer belt 30 to be transferred to a proper position on the sheet S.

The fixing device 50 applies heat and pressure to the sheet S passing through the device. The toner image is thus fixed to the sheet S. After that, the sheet S is ejected to a tray 48.

While there has been described the image forming apparatus 100 adopting a tandem system as a printing method, the printing method of the image forming apparatus 100 is not limited to the tandem system. The arrangement of each component in the image forming apparatus 100 can be modified as appropriate in accordance with the printing method being adopted. As the printing method of the image forming apparatus 100, a rotary method or a direct transfer method may be adopted. In the case of the rotary method, the image forming apparatus 100 includes one photoreceptor 10 and a plurality of developing units 13 that is configured to be able to rotate coaxially. The image forming apparatus 100 at the time of printing guides the developing units 13 in turn to the photoreceptor 10 and develops the toner image of each color. In the case of the direct transfer method, the image forming apparatus 100 directly transfers the toner image formed on the photoreceptor 10 to the sheet S.

[Inner Structure of Fixing Device 50]

Figure 2:
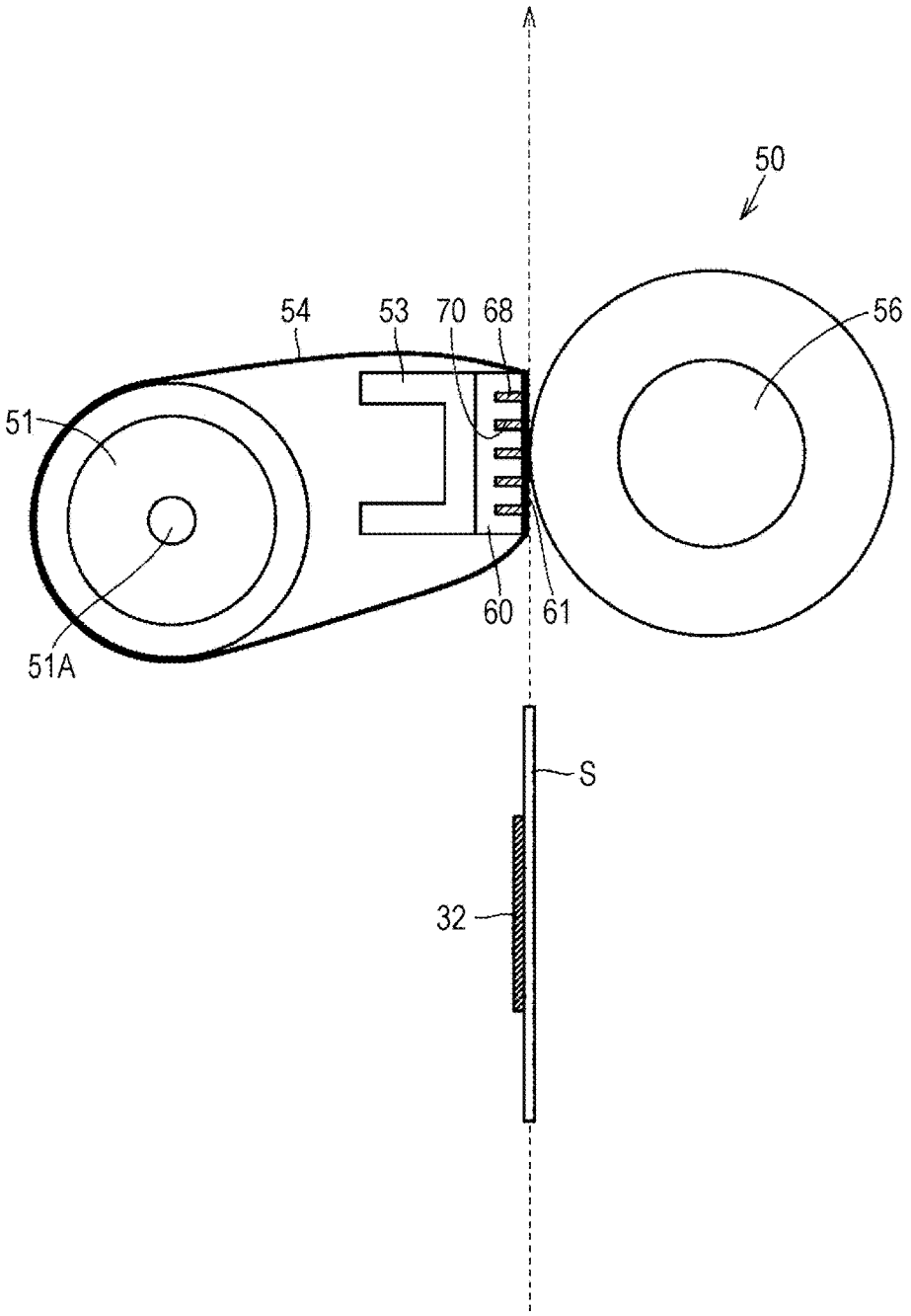
FIG. 2 is a diagram illustrating an internal structure of a fixing device according to the first embodiment.

The fixing device 50 illustrated in FIG. 1 will be further described with reference to FIG. 2. FIG. 2 is a diagram illustrating the internal structure of the fixing device 50 according to the first embodiment.

As illustrated in FIG. 2, the fixing device 50 includes a heating roller 51, a support member 53, a fixing belt 54, a sliding member 60, and a pressure roller 56.

The outer diameter of the heating roller 51 is, for example, 20 mm to 30 mm. The heating roller 51 is formed of a metal core and a surface layer, for example. The metal core is made of aluminum and is a hollow rotating body having a cylindrical shape, for example. The thickness of the metal core is 2 mm, for example. The surface layer of the heating roller 51 is formed on the outer peripheral surface of the metal core. The surface layer of the heating roller 51 is preferably coated with a heat-resistant perfluoroalkyl ether (PFA) tube. The heating roller 51 is formed as a hard roller.

A heater 51A such as a halogen heater is disposed on the inner surface of the heating roller 51 as a heating unit that heats the fixing belt 54. The heating roller 51 is heated by the heater 51A and transfers heat received from the heater 51A to the fixing belt 54. The fixing belt 54 is heated by the heater 51A via the heating roller 51.

The fixing belt 54 is an endless belt with flexibility. The fixing belt 54 is stretched across the heating roller 51 and the sliding member 60 to be able to rotate. The heating roller 51 and the sliding member 60 are provided on the inner periphery of the fixing belt 54. The fixing belt 54 rotates to transfer the heat received from the heating roller 51 to a nip region which is an area of contact between the fixing belt 54 and the pressure roller 56. The sheet S passes through the nip region formed between the fixing belt 54 and the pressure roller 56, so that a toner image 32 transferred to the sheet S is heated and pressured to fuse on the sheet S. The toner image 32 is thus fixed to the sheet S.

The fixing belt 54 is formed of a base layer and an elastic layer, for example. The base layer of the fixing belt 54 is made of a heat-resistant resin such as polyimide. The base layer of the fixing belt 54 has an inner diameter of 50 mm, a width of 330 mm, and a thickness of 70 μm. The elastic layer of the fixing belt 54 is made of a heat-resistant material such as silicone rubber. The thickness of the elastic layer of the fixing belt 54 is, for example, 200 μm. The surface of the fixing belt 54 may be coated with a release layer such as a PFA tube having a thickness of 30 μm.

The sliding member 60 is disposed so as to face the pressure roller 56 with the fixing belt 54 interposed therebetween. The sliding member 60 is fixed to the support member 53 such that the fixing belt 54 is pressed against the pressure roller 56. Accordingly, the elastic layer of the pressure roller 56 is deformed to form the nip region between the fixing belt 54 and the pressure roller 56. The sliding member 60 is made of a heat-resistant resin such as polyphenylene sulfide, polyimide, or a liquid crystal polymer, for example. The sliding member 60 has a sliding surface 61 that slides with respect to the fixing belt 54. The sliding surface 61 of the sliding member 60 may be coated with a low friction coating such as polytetrafluoroethylene (PTFE) or a sheet material.

The sliding member 60 has a thickness of 4 mm and a lateral length of 15 mm, for example. The sliding member 60 is longer than the width of the sheet S in the axial direction of the heating roller 51. In the case of a device adapted for an A3 size sheet S to pass therethrough, the sliding member 60 has a longitudinal length of 350 mm.

The pressure roller 56 as an example of a pressure member is in contact with the outer peripheral surface of the fixing belt 54. The outer diameter of the pressure roller 56 is, for example, 20 mm to 40 mm. The pressure roller 56 is driven by a drive unit such as a motor (not shown) to rotate. When the pressure roller 56 rotates, the rotational force of the pressure roller 56 is conveyed to the fixing belt 54. As a result, the fixing belt 54 is rotated by the rotation of the pressure roller 56. The pressure roller 56 presses the sliding member 60 via the fixing belt 54.

The pressure roller 56 is, for example, formed of a metal core, an intermediate layer, and a surface layer. The metal core is made of metal such as aluminum or iron. The thickness of the metal core is, for example, approximately 1 mm to 5 mm. The intermediate layer of the pressure roller 56 is formed of an elastic material having heat resistance. Heat-resistant silicone rubber with the thickness of 3 mm can be adopted as the elastic material, for example. The surface layer of the pressure roller 56 is made of a material having releasability. A PFA tube with the thickness of 30 μm can be used as the material of the surface layer of the pressure roller 56. The pressure roller 56 is formed as a soft roller.

The sliding member 60 slides with respect to the inner peripheral surface of the fixing belt 54 via a lubricant 68. The lubricant 68 is retained on the sliding surface 61 of the sliding member 60 that is in contact with the inner peripheral surface of the fixing belt 54. The lubricant 68 can be silicone oil or fluorine grease, for example. The lubricant 68 is supplied to the inner peripheral surface of the fixing belt 54 to reduce the sliding friction between the fixing belt 54 and the sliding member 60. As a result, the torque of the fixing belt 54 is decreased, whereby a conveyance failure or printing misalignment of the sheet S can be mitigated.

[Structure of Sliding Surface 61]

Figure 3:
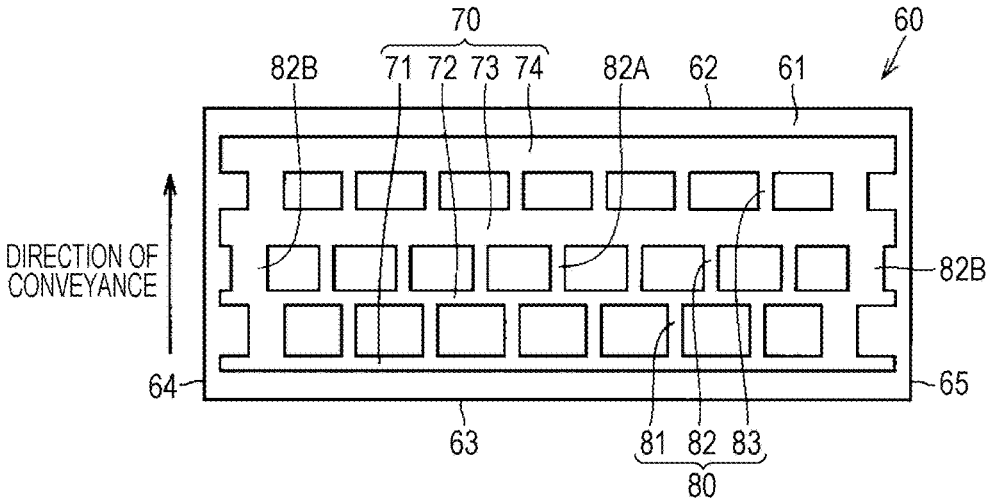
FIG. 3 is a diagram illustrating a sliding surface of a sliding member of the fixing device according to the first embodiment.

FIG. 3 is a diagram illustrating the sliding surface 61 of the sliding member 60 of the fixing device 50 according to the first embodiment. The sliding surface 61 is a surface in contact with the inner peripheral surface of the fixing belt 54. A plurality of grooves is formed on the sliding surface 61. The lubricant 68 (FIG. 2) is retained in the grooves formed on the sliding surface 61. The sliding surface 61 illustrated in FIG. 3 has a downstream edge 62, an upstream edge 63, and a pair of side edges 64 and 65.

The direction of conveyance indicated in FIG. 3 is the direction in which the fixing belt 54 rotating at the time of conveying the sheet S slides on the sliding surface 61. The direction of conveyance corresponds to the lateral direction of the sliding member 60. The direction of conveyance corresponds to a vertical direction in FIG. 3. A lower side in FIG. 3 corresponds to an upstream side of the direction of conveyance, while an upper side in FIG. 3 corresponds to a downstream side of the direction of conveyance. A direction orthogonal to the direction of conveyance is referred to as an orthogonal direction. The orthogonal direction corresponds to the longitudinal direction of the sliding member 60. The orthogonal direction corresponds to a horizontal direction in FIG. 3.

A first groove 70 extending in the orthogonal direction and a second groove 80 extending in the direction of conveyance are formed on the sliding surface 61. A plurality of the first grooves 70 is formed on the sliding surface 61. The first grooves 70 extend in the direction intersecting the direction of conveyance (the direction orthogonal to the direction of conveyance in the case of the present embodiment). The first grooves 70 include grooves 71, 72, 73, and 74. The grooves 71 to 74 are formed in parallel with one another. A plurality of the second grooves 80 is formed on the sliding surface 61. The second grooves 80 include grooves 81, 82, and 83. The grooves 81 to 83 are formed in parallel with one another.

The grooves 71, 72, 73, and 74 are formed in this order from the upstream side to the downstream side of the direction of conveyance. Among the first grooves 70, the groove 71 is formed on the uppermost stream side in the direction of conveyance, while the groove 74 is formed on the lowermost stream side in the direction of conveyance. The second groove 80 allows two of the plurality of first grooves 70 adjacent to each other to communicate with each other. The groove 81 allows the groove 71 and the groove 72 to communicate with each other. The groove 82 allows the groove 72 and the groove 73 to communicate with each other. The groove 83 allows the groove 73 and the groove 74 to communicate with each other.

A plurality of the grooves 81 is formed between the groove 71 and the groove 72. The groove 71 and the groove 72 adjacent to each other in the direction of conveyance communicate with each other via at least one of the grooves 81. An end of the groove 81 on the upstream side in the direction of conveyance is connected to the groove 71. An end of the groove 81 on the downstream side in the direction of conveyance is connected to the groove 72. The plurality of grooves 81 is formed in parallel with one another.

A plurality of the grooves 82 is formed between the groove 72 and the groove 73. The groove 72 and the groove 73 adjacent to each other in the direction of conveyance communicate with each other via at least one of the grooves 82. An end of the groove 82 on the upstream side in the direction of conveyance is connected to the groove 72. An end of the groove 82 on the downstream side in the direction of conveyance is connected to the groove 73. The plurality of grooves 82 is formed in parallel with one another.

A plurality of the grooves 83 is formed between the groove 73 and the groove 74. The groove 73 and the groove 74 adjacent to each other in the direction of conveyance communicate with each other via at least one of the grooves 83. An end of the groove 83 on the upstream side in the direction of conveyance is connected to the groove 73. An end of the groove 83 on the downstream side in the direction of conveyance is connected to the groove 74. The plurality of grooves 83 is formed in parallel with one another.

The grooves 81, 82, and 83 making up the second grooves 80 are not arranged on a straight line in the direction of conveyance but are out of phase in the direction of conveyance. The first groove 70 and the second groove 80 are arranged in a non-grid pattern.

Specifically, as illustrated in FIG. 3, the groove 81 communicates with the groove 72 on the upstream side in the direction of conveyance, whereas the groove 82 communicates with the groove 72 on the downstream side in the direction of conveyance. The position at which the groove 81 communicates with the groove 72 and the position at which the groove 82 communicates with the groove 72 are shifted from each other in the direction in which the groove 72 extends (in the orthogonal direction in the case of the present embodiment).

The groove 82 communicates with the groove 73 on the upstream side in the direction of conveyance, whereas the groove 83 communicates with the groove 73 on the downstream side in the direction of conveyance. The position at which the groove 82 communicates with the groove 73 and the position at which the groove 83 communicates with the groove 73 are shifted from each other in the direction in which the groove 73 extends (in the orthogonal direction in the case of the present embodiment).

Two ends of the first groove 70 extending in the orthogonal direction are arranged at positions away from the edges of the sliding surface 61. As illustrated in FIG. 3, the first groove 70 does not reach the pair of side edges 64 and 65 of the sliding surface 61. The first groove 70 does not reach the downstream edge 62 or the upstream edge 63 of the sliding surface 61. The two ends of the first groove 70 are formed within the sliding surface 61.

Among the plurality of grooves making up the first grooves 70, the grooves 73 and 74 formed on the downstream side in the direction of conveyance are wider than the grooves 71 and 72 formed on the upstream side in the direction of conveyance. Among the plurality of second grooves 80 allowing two of the first grooves 70 adjacent to each other to communicate with each other, a groove (such as a groove 82A illustrated in FIG. 3) formed at the center in the orthogonal direction is narrower than a groove (such as a groove 82B illustrated in FIG. 3) formed at the end in the orthogonal direction.

Figure 4:
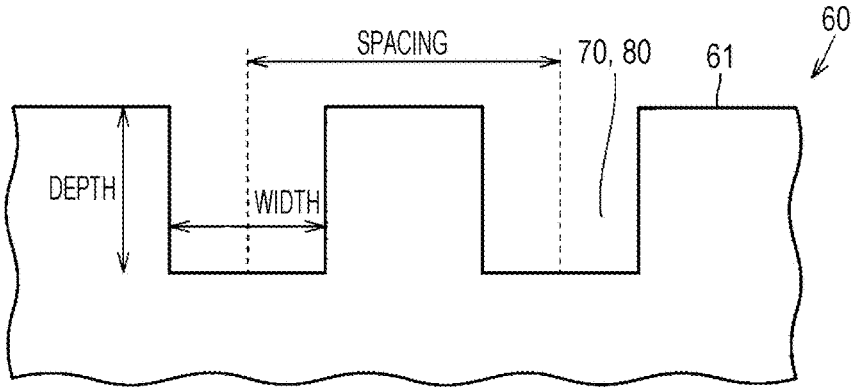
FIG. 4 is a schematic cross-sectional view of the sliding member illustrating the width and depth of a groove as well as spacing between grooves.

The width, depth and spacing of the grooves will be described with reference to FIG. 4. FIG. 4 is a schematic cross-sectional view of the sliding member 60 illustrating the width and depth of the groove as well as the spacing between the grooves. FIG. 4 illustrates a cross-sectional view of the sliding member 60 in the direction orthogonal to the direction in which each of the grooves extends. More specifically, FIG. 4 illustrates the first groove 70 appearing in the cross section of the sliding member 60 along the direction of conveyance, or the second groove 80 appearing in the cross section of the sliding member 60 along the orthogonal direction.

Spacing between a pair of inner wall surfaces of the first grooves 70 or the second grooves 80 appearing in the cross section in FIG. 4 is referred to as the width of the groove. A distance between the centers of the widths of the two grooves adjacent to each other is referred to as the spacing between the grooves. A distance between the sliding surface 61 of the sliding member 60 and a bottom surface of the groove is referred to as the depth of the groove. Note that while FIG. 4 illustrates, as an example, the inner wall surface of the groove extending in a direction orthogonal to the planar sliding surface 61 and the bottom surface of the groove extending in a direction parallel to the sliding surface 61, the first groove 70 and the second groove 80 may also be formed in any shape.

The width of each of the first groove 70 and the second groove 80 is preferably 5 μm or larger since it is harder for the lubricant 68 to go into the groove when the width is narrow. On the other hand, the width of each of the first groove 70 and the second groove 80 is desirably 500 μm or smaller so as to inhibit the occurrence of an image defect due to the deflection of the fixing belt 54.

The depth of each of the first groove 70 and the second groove 80 is preferably 50 μm or larger because, when the groove is shallow, the lubricant 68 is more likely to adhere to the inner peripheral surface of the fixing belt 54 and be unevenly retained upon being conveyed by the fixing belt 54. On the other hand, the depth of each of the first groove 70 and the second groove 80 is desirably 100 μm or smaller so as to inhibit the occurrence of the image defect due to the deflection of the fixing belt 54.

The lubricant 68 needs to cover the entire surface of the sliding member 60 in order to reduce the sliding friction on the sliding surface 61 and use the fixing belt 54 and the sliding member 60 over a long period of time. The amount of the lubricant 68 that needs to be retained in the configuration of the present embodiment is 3.0 mg/cm$^2$ or more. The spacing between the grooves is specified on the basis of concentration of the lubricant 68 as well as the width and depth of the groove.

In view of these conditions, according to the present embodiment, each of the grooves 71 and 72 of the first grooves 70 on the upstream side in the direction of conveyance has the width of 75 μm and the depth of 60 μm. The spacing between the grooves is set to 150 μm since 67 grooves are required per 1 cm in order to secure the volume of the groove capable of retaining the minimum amount of the lubricant of 3.0 mg/cm$^2$. In order to be able to retain more of the lubricant 68, each of the grooves 73 and 74 of the first grooves 70 on the downstream side in the direction of conveyance has the width of 100 μm which is wider than the groove on the upstream side, the depth of 60 μm and the spacing of 150 μm.

Among the second grooves 80, the groove (such as the groove 82A illustrated in FIG. 3) formed at the center in the orthogonal direction has the width of 75 μm, the depth of 60 μm and the spacing of 150 μm. In order to be able to retain more of the lubricant 68, the groove (such as the groove 82B illustrated in FIG. 3) formed at the end in the orthogonal direction has the width of 100 μm which is wider than the groove formed at the center, the depth of 60 μm and the spacing of 150 μm.

[Operation of Image Forming Apparatus 100]

Figure 5:
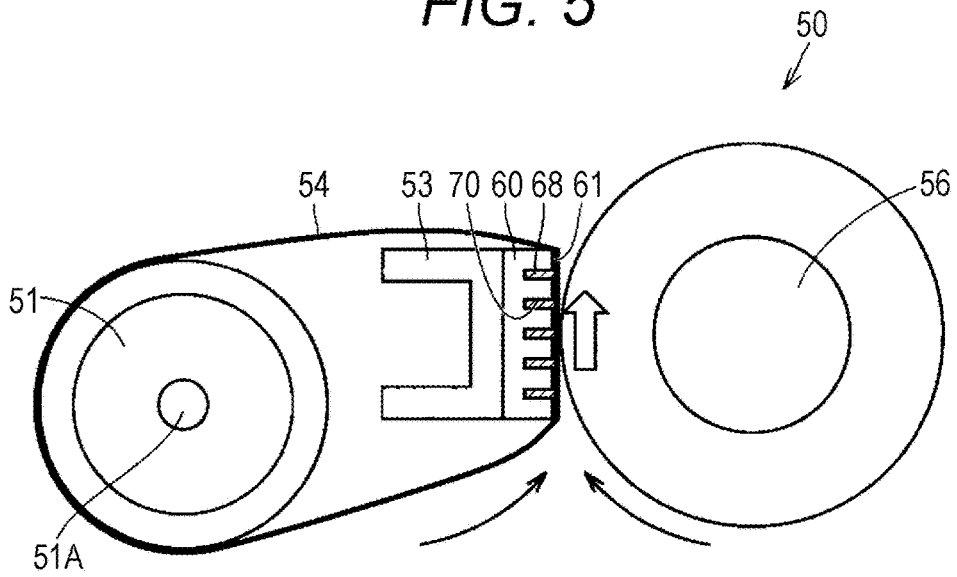
FIG. 5 is a diagram illustrating the fixing device when a belt is driven normally.

The operations of the image forming apparatus 100 will be described below. FIG. 5 is a diagram illustrating the fixing device 50 when the belt is driven normally. After the toner image 32 illustrated in FIG. 2 is transferred to the surface of the sheet S, the sheet is conveyed toward the fixing device 50. The pressure roller 56 is driven by the drive unit (not shown) as described above and is rotated clockwise as indicated by an arrow in FIG. 5. Following the pressure roller 56, the fixing belt 54 is rotated counterclockwise as indicated by an arrow in FIG. 5. Accordingly, the conveying force as indicated by an outlined arrow in FIG. 5 is generated.

When the sheet S passes through the nip region between the fixing belt 54 and the pressure roller 56, the toner image 32 transferred to the sheet S is heated and pressured to be fixed to the sheet S. A color image is thus formed on the sheet S. The sheet S to which the toner image 32 has been fixed is ejected to the tray 48 (FIG. 1).

In the fixing device 50 of the present embodiment, the sheet S is fed through the device vertically upward. The direction of the conveying force illustrated in FIG. 5 is vertically upward. The fixing belt 54 rotating at the time of conveying the sheet S slides upward in the vertical direction on the sliding surface 61 of the sliding member 60. The conveying force generated by the driving of the fixing belt 54 allows the lubricant 68 to move to the downstream side in the direction of conveyance. Therefore, in FIG. 5, the lubricant 68 is retained more on the downstream side in the direction of conveyance of the sliding member 60.

Figure 6:
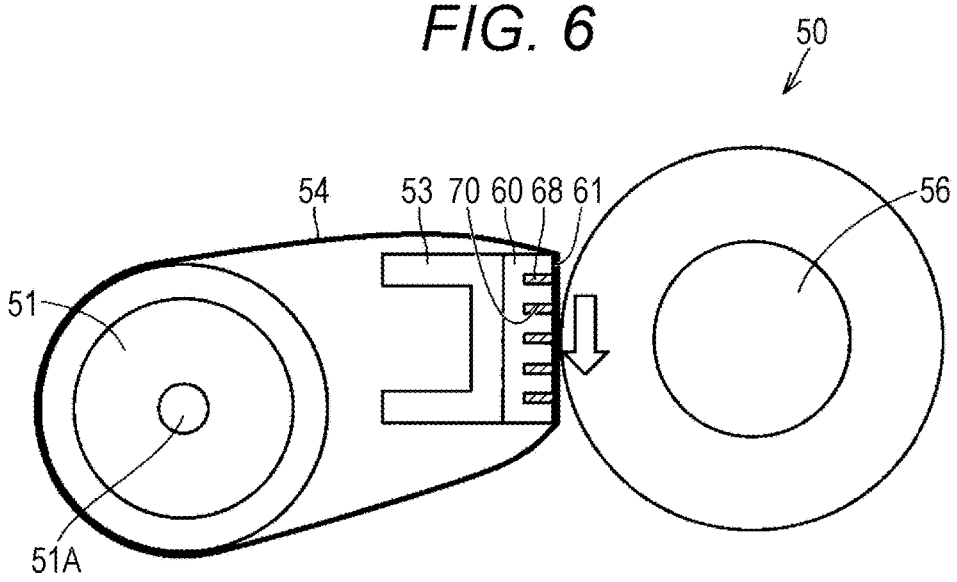
FIG. 6 is a diagram illustrating the fixing device when the belt is not driven.

FIG. 6 is a diagram illustrating the fixing device 50 when the belt is not driven. The conveying force in the vertically upward direction as illustrated in FIG. 5 is not exerted when the pressure roller 56 is not driven and rotated and thus the fixing belt 54 is not driven and rotated. Gravity acts on the lubricant 68 at this time in a direction indicated by an outlined arrow in FIG. 6. The lubricant 68 thus passes through the second groove 80 and moves from the downstream side to the upstream side in the direction of conveyance of the sliding member 60. The lubricant 68 returns to the upstream side in the direction of conveyance by its own weight, whereby the unevenness of the lubricant 68 retained more on the downstream side in the direction of conveyance is eliminated.

[Workings and Effect]

Next, the workings and effects of the fixing device 50 of the first embodiment described above will be described.

The fixing device 50 of the present embodiment includes the sliding member 60 as illustrated in FIG. 2. The sliding member 60 has the sliding surface 61 in contact with the inner peripheral surface of the fixing belt 54. As illustrated in FIG. 3, the plurality of first grooves 70 extending in the orthogonal direction is formed on the sliding surface 61. The plurality of second grooves 80 allowing two of the plurality of first grooves 70 adjacent to each other to communicate with each other is also formed on the sliding surface 61.

When the lubricant 68 is retained more toward the downstream side in the direction of conveyance of the sliding member 60 by the conveying force generated by the driving of the fixing belt 54, the second groove 80 extending in the direction of conveyance and formed on the sliding surface 61 allows the lubricant 68 to pass through the second groove 80 and return to the upstream side in the direction of conveyance of the sliding member 60 while the rotation of the fixing belt 54 is stopped. Accordingly, the unevenness of the lubricant 68 in the direction of conveyance can be eliminated on the sliding surface 61. Therefore, an increase in the sliding friction due to a shortage of the lubricant 68 on the upstream side in the direction of conveyance can be inhibited. There can also be inhibited a leakage of the lubricant 68 retained more on the downstream side in the direction of conveyance of the sliding member 60 from the sliding surface 61, thereby avoiding a situation in which the amount of the lubricant 68 retained on the sliding member 60 as a whole is reduced to increase the sliding friction.

The first groove 70 and the second groove 80 are formed in the non-grid pattern to be able to restrict the speed of the lubricant 68 moving to the downstream side in the direction of conveyance through the second groove 80 when the conveying force of the fixing belt 54 is exerted. This can inhibit the lubricant 68 from being retained more on the downstream side in the direction of conveyance in a short period of time, thereby inhibiting the increase in the sliding friction due to the shortage of the lubricant 68 on the upstream side in the direction of conveyance.

As illustrated in FIG. 3, the width of the second groove 80 varies between the center of the sliding surface 61 and the edge thereof in the orthogonal direction. The width of the second groove 80 is not fixed but varies, so that the amount of the lubricant 68 retained in the groove varies between the center and the edge. The amount of the lubricant 68 retained in each of the grooves is designed optimally to be able to inhibit the leakage of the lubricant 68 from the sliding surface 61.

Moreover, as illustrated in FIG. 3, the second groove 80 (the groove 82B illustrated in FIG. 3) formed on the edge of the sliding surface 61 in the orthogonal direction is wider than the second groove 80 (the groove 82A illustrated in FIG. 3) formed at the center of the sliding surface 61 in the orthogonal direction. This allows the second groove 80 formed on the edge of the sliding surface 61 to retain a larger amount of the lubricant 68. The lubricant 68 can thus be retained in the second groove 80 even when the lubricant 68 is moved more to the edge of the sliding surface 61, whereby the leakage of the lubricant 68 from the sliding surface 61 can be inhibited.

In place of the configuration in FIG. 3 in which the width of the second groove 80 varies between the center of the sliding surface 61 and the edge thereof in the orthogonal direction, the depth of the second groove 80 or the spacing between the second grooves 80 may be varied. More specifically, the depth of the second groove 80 formed on the edge of the sliding surface 61 may be deeper than the second groove 80 formed at the center of the surface. Alternatively, the spacing between the second grooves 80 formed on the edge of the sliding surface 61 may be made smaller than the spacing between the second grooves 80 formed at the center of the surface. As a result, the second groove 80 formed on the edge of the sliding surface 61 retains a larger amount of the lubricant 68 to be able to similarly obtain the effect of inhibiting the leakage of the lubricant 68 from the sliding surface 61.

As illustrated in FIG. 3, the position at which the second groove 80 communicates with the first groove 70 on the upstream side in the direction of conveyance and the position at which the second groove 80 communicates with the first groove on the downstream side in the direction of conveyance are shifted from each other in the direction in which the first groove 70 extends. This can restrict the speed of the lubricant 68 moving to the downstream side in the direction of conveyance through the second groove 80 when the conveying force of the fixing belt 54 is exerted. This can inhibit the lubricant 68 from being retained more on the downstream side in the direction of conveyance in a short period of time, thereby inhibiting the increase in the sliding friction due to the shortage of the lubricant 68 on the upstream side in the direction of conveyance.

As illustrated in FIG. 3, the width of the first groove 70 varies between the upstream side and the downstream side in the direction of conveyance. The width of the first groove 70 is not fixed but varies, so that the amount of the lubricant 68 retained in the groove varies between the upstream side and the downstream side in the direction of conveyance. The amount of the lubricant 68 retained in each of the grooves is designed optimally to be able to inhibit the leakage of the lubricant 68 from the sliding surface 61.

As illustrated in FIG. 3, the first grooves 70 (the grooves 73 and 74 illustrated in FIG. 3) formed on the downstream side in the direction of conveyance are wider than the first grooves 70 (the grooves 71 and 72 illustrated in FIG. 3) formed on the upstream side in the direction of conveyance. This allows the first grooves 70 formed on the downstream side in the direction of conveyance to retain a larger amount of the lubricant 68. The lubricant 68 can thus be retained in the first grooves 70 even when the lubricant 68 is moved more to the downstream side in the direction of conveyance, whereby the leakage of the lubricant 68 from the sliding surface 61 can be inhibited.

In place of the configuration in FIG. 3 in which the width of the first groove 70 varies between the upstream side and the downstream side in the direction of conveyance, the depth of the first groove 70 or the spacing between the first grooves 70 may be varied. More specifically, the depth of the first groove 70 formed on the downstream side in the direction of conveyance may be deeper than the first groove 70 formed on the upstream side. Alternatively, the spacing between the first grooves 70 formed on the downstream side in the direction of conveyance may be smaller than the spacing between the first grooves 70 formed on the upstream side. As a result, the first groove 70 formed on the downstream side in the direction of conveyance retains a larger amount of the lubricant 68 to be able to similarly obtain the effect of inhibiting the leakage of the lubricant 68 from the sliding surface 61.

As illustrated in FIG. 3, the two ends of the first groove 70 are arranged at the positions away from the side edges 64 and 65 of the sliding surface 61. The first groove 70 is formed so as not to reach the side edges 64 and 65 of the sliding surface 61, whereby the leakage of the lubricant 68 from the side edges 64 and 65 of the sliding surface 61 can be inhibited.

As illustrated in FIG. 5, the direction of conveyance corresponds to the vertically upward direction. This allows the lubricant 68 to move to the upstream side in the direction of conveyance by its own weight when the fixing belt 54 is not rotated. Accordingly, the unevenness of the lubricant 68 in the direction of conveyance on the sliding surface 61 can be eliminated to be able to inhibit the increase in the sliding friction caused by the shortage of the lubricant 68 on the upstream side in the direction of conveyance.

Each of the first groove 70 and the second groove 80 has the width of 5 μm or larger and 500 μm or smaller, and the depth of 50 μm or larger and 100 μm or smaller. As a result, the lubricant 68 can be surely retained in the first groove 70 and the second groove 80 to be able to inhibit the occurrence of an image defect.

Second Embodiment

[Structure of Sliding Surface 61]

Figure 7:
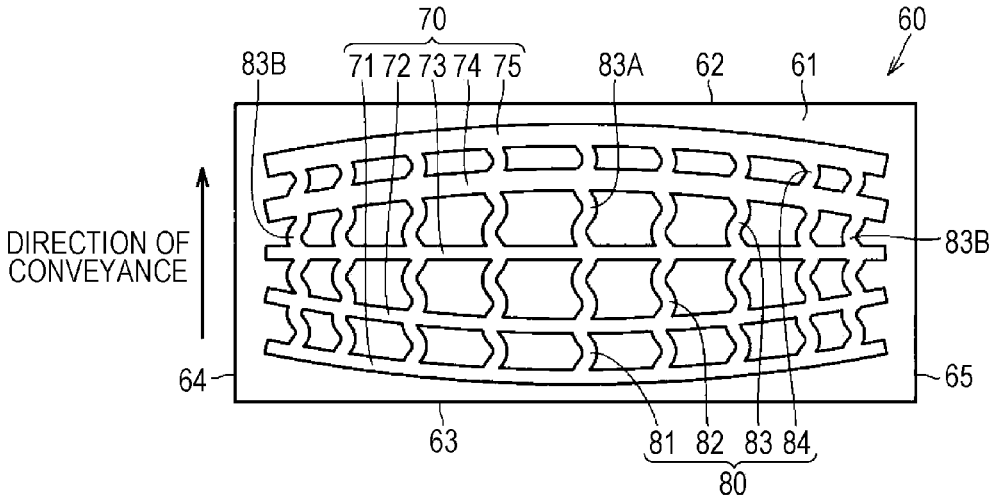
FIG. 7 is a diagram illustrating a sliding surface of a sliding member of a fixing device according to a second embodiment.

FIG. 7 is a diagram illustrating a sliding surface 61 of a sliding member 60 of a fixing device 50 according to a second embodiment. The fixing device 50 according to the second embodiment is different from that of the first embodiment in terms of the form of grooves formed on the sliding surface 61. Specifically, the first groove 70 and the second groove 80 of the first embodiment are formed in a straight line, whereas a first groove 70 and a second groove 80 may be formed in the form that is not a straight line as illustrated in FIG. 7.

The first groove 70 is formed on an edge of the sliding surface 61 in a direction of conveyance at the center of the sliding surface 61 in an orthogonal direction, and is formed away from the edge of the sliding surface 61 in the direction of conveyance on an edge of the sliding surface 61 in the orthogonal direction. More specifically, among the first grooves 70, grooves 71 and 72 on the upstream side of the direction of conveyance are formed closer to an upstream edge 63 of the sliding surface 61 at the center of the sliding surface 61 in the orthogonal direction, and are curved in an arc shape so as to be away from the upstream edge 63 in the vicinity of a pair of side edges 64 and 65 of the sliding surface 61. Among the first grooves 70, grooves 74 and 75 on the downstream side of the direction of conveyance are formed closer to a downstream edge 62 of the sliding surface 61 at the center of the sliding surface 61 in the orthogonal direction, and are curved in an arc shape so as to be away from the downstream edge 62 in the vicinity of the pair of side edges 64 and 65 of the sliding surface 61.

The second groove 80 is formed into a non-linear shape. More specifically, the second groove 80 is formed into the shape of a wavy line. Among the second grooves 80, a groove (such as a groove 83B illustrated in FIG. 7) formed on the edge in the orthogonal direction has narrower spacing from an adjacent groove than a groove (such as a groove 83A illustrated in FIG. 7) formed at the center in the orthogonal direction does.

Among the first grooves 70, each of the grooves 71 and 72 on the upstream side in the direction of conveyance has the width of 75 μm, the depth of 60 μm, and the spacing of 150 μm in order to ensure the minimum amount 3.0 mg/cm$^2$ of a lubricant 68 retained. In order to be able to retain more of the lubricant 68, each of the grooves 74 and 75 of the first grooves 70 on the downstream side in the direction of conveyance has the width of 100 μm which is wider than the groove on the upstream side, the depth of 60 μm and the spacing of 150 μm.

Among the second grooves 80, the groove (such as the groove 83A illustrated in FIG. 7) formed at the center in the orthogonal direction has the width of 75 μm, the depth of 60 μm and the spacing of 150 μm. In order to be able to retain more of the lubricant 68, the groove (such as the groove 83B illustrated in FIG. 7) formed at the end in the orthogonal direction has the width of 75 μm, the depth of 60 μm and the spacing of 120 μm which is narrower than that of the groove on the upstream side.

[Workings and Effect]

In the fixing device 50 of the second embodiment described above, the second grooves 80 are formed into the non-linear shape as illustrated in FIG. 7. This can restrict the speed of the lubricant 68 moving to the downstream side in the direction of conveyance through the second groove 80 when the conveying force of a fixing belt 54 is exerted. This can inhibit the lubricant 68 from being retained more on the downstream side in the direction of conveyance in a short period of time, thereby inhibiting the increase in the sliding friction due to a shortage of the lubricant 68 on the upstream side in the direction of conveyance.

The form of the second groove 80 is not limited to the wavy line illustrated in FIG. 7. The second groove 80 may be formed in any curved form, a combination of any linear forms, or a combination of any curved form and a linear form as long as the groove does not extend linearly between two adjacent grooves of the plurality of first grooves 70. The non-linear second groove 80 allowing the two adjacent first grooves 70 to communicate with each other may be formed while being shifted in position in the direction in which the first groove 70 extends, as described in the first embodiment.

As illustrated in FIG. 7, the first groove 70 is formed on the edge of the sliding surface 61 in the direction of conveyance at the center of the sliding surface 61 in the orthogonal direction, and is formed away from the edge of the sliding surface 61 in the direction of conveyance on the edge of the sliding face 61 in the orthogonal direction. When the conveying force generated by driving of the fixing belt 54 acts on the lubricant 68 to move toward the downstream side in the direction of conveyance as described in the first embodiment, a force acts on the lubricant 68 to move toward the center of the grooves 74 and 75 in the grooves 74 and 75 on the downstream side in the direction of conveyance. When a force acts on the lubricant 68 to move toward the upstream side in the direction of conveyance by its own weight, a force acts on the lubricant 68 to move toward the center of the grooves 71 and 72 in the grooves 71 and 72 on the upstream side in the direction of conveyance. This can thus inhibit the lubricant 68 from being retained more on the edge of the orthogonal direction.

Third Embodiment

[Configuration of Fixing Device 50]

Figure 8:
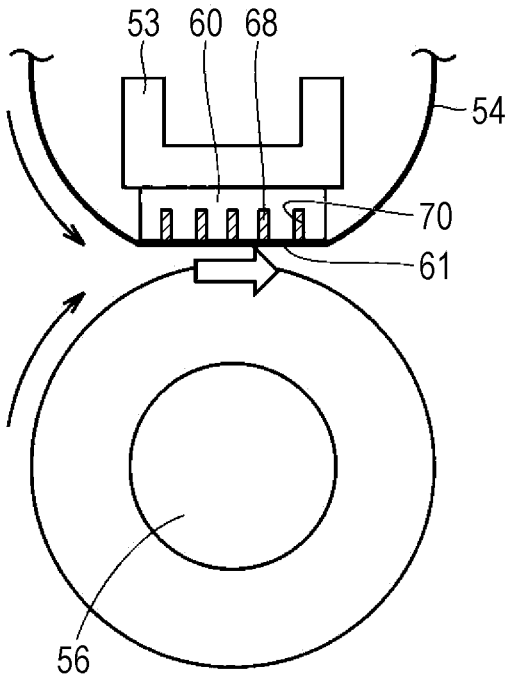
FIG. 8 is a diagram illustrating a fixing device according to a third embodiment when a belt is driven normally.

FIG. 8 is a diagram illustrating a fixing device 50 according to a third embodiment when a belt is driven normally. While the direction of conveyance of the fixing device 50 according to the first embodiment corresponds to the vertically upward direction as illustrated in FIG. 5, the direction of conveyance is not limited to such configuration. The direction of conveyance may be a horizontal direction as illustrated in FIG. 8. In this case, a fixing belt 54 is configured to be able to move in both the direction of conveyance and a direction opposite to the direction of conveyance selectively with respect to a sliding surface 61.

Figure 9:
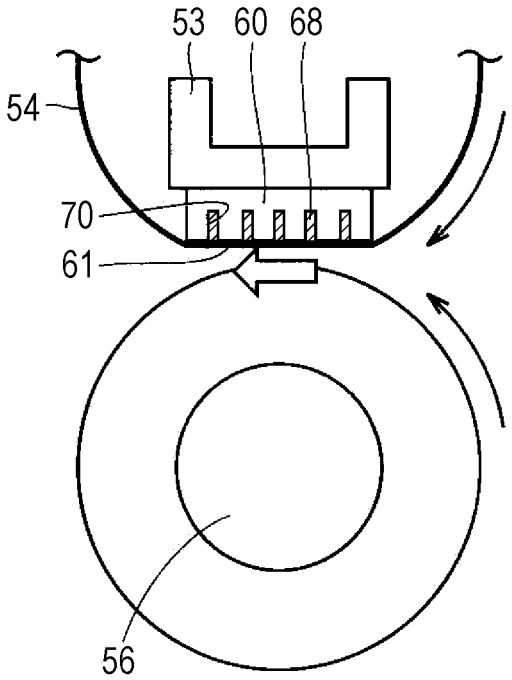
FIG. 9 is a diagram illustrating the fixing device according to the third embodiment when the belt is rotated in a reverse direction.

FIG. 9 is a diagram illustrating the fixing device 50 according to the third embodiment when the belt is rotated in the reverse direction. When the belt is driven normally as illustrated in FIG. 8, a conveying force of the fixing belt 54 acting in the direction indicated by an outlined arrow in FIG. 8 causes a lubricant 68 to move toward a downstream side in the direction of conveyance. The fixing belt 54 is rotated in the reverse direction as illustrated in FIG. 9 when printing is not performed. Accordingly, a conveying force of the fixing belt 54 acting in the direction indicated by an outlined arrow in FIG. 9, which is opposite to the direction at the time the belt is driven normally, causes the lubricant 68 to move toward an upstream side in the direction of conveyance.

The unevenness of the lubricant 68 in the direction of conveyance can thus be eliminated to be able to inhibit an increase in sliding friction caused by a shortage of the lubricant 68 on the upstream side in the direction of conveyance. There can also be inhibited a leakage of the lubricant 68 retained more on the downstream side in the direction of conveyance of the sliding member 60 out of the sliding surface 61, thereby avoiding a situation in which the amount of the lubricant 68 retained on the sliding member 60 as a whole is reduced to increase the sliding friction.

[Controlling Fixing Device 50]

The reverse rotation of the fixing belt 54 as illustrated in FIG. 9 increases the time for which the fixing belt 54 is rotated and affects the life of the fixing device 50. It is thus desired to properly control the reverse rotation of the fixing belt 54 on the basis of a state of unevenness of the lubricant 68 retained in the sliding member 60.

Figure 10:
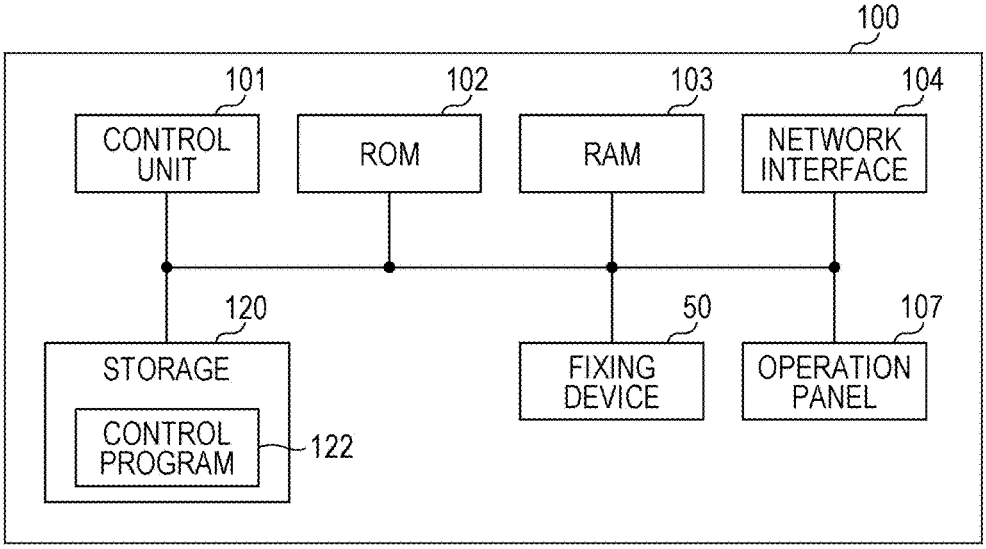
FIG. 10 is a block diagram illustrating the configuration of principal hardware of an image forming apparatus.

FIG. 10 is a block diagram illustrating the configuration of principal hardware of an image forming apparatus 100. An example of the hardware configuration of the image forming apparatus 100 will be described with reference to FIG. 10.

As illustrated in FIG. 10, the image forming apparatus 100 includes the fixing device 50, a control unit 101, a read only memory (ROM) 102, a random access memory (RAM) 103, a network interface 104, an operation panel 107, and a storage 120.

The control unit 101 is formed of at least one integrated circuit, for example. The integrated circuit is for example formed of at least one central processing unit (CPU), at least one application specific integrated circuit (ASIC), at least one field programmable gate array (FPGA), or a combination of these.

The control unit 101 controls the operation of the image forming apparatus 100 by executing various programs such as a control program 122 according to the present embodiment. The control unit 101 reads the control program 122 from the storage 120 to the ROM 102 upon accepting an execution command for the control program 122. The RAM 103 functions as a working memory to temporarily store various data required for executing the control program 122.

An antenna (not shown) or the like is connected to the network interface 104. The image forming apparatus 100 exchanges data with an external communication device via the antenna. The external communication device includes a mobile communication terminal such as a smart phone and a server, for example. The image forming apparatus 100 may be configured to be able to download the control program 122 from the server via the antenna.

The operation panel 107 is formed of a display and a touch panel. The display and the touch panel are arranged on top of each other to allow the operation panel 107 to accept a print operation and a scan operation to be performed by the image forming apparatus 100.

The storage 120 is a storage medium such as a hard disk or an external storage, for example. The storage 120 stores the control program 122 or the like according to the present embodiment. The control program 122 need not necessarily be stored in the storage 120 but may be stored in a storage area (such as a cache) of the control unit 101, the ROM 102, the RAM 103, or the external device (such as the server).

The control program 122 may be provided not as a single program but may be provided while being incorporated into a part of an arbitrary program. In this case, control processing according to the present embodiment is implemented in cooperation with the arbitrary program. Such program not including some module does not depart from the gist of the control program 122 according to the present embodiment. Moreover, apart or all of the function provided by the control program 122 may be implemented by dedicated hardware. The image forming apparatus 100 may also be configured such that at least one server executes a part of processing in the control program 122 like a so-called cloud service.

Figure 11:
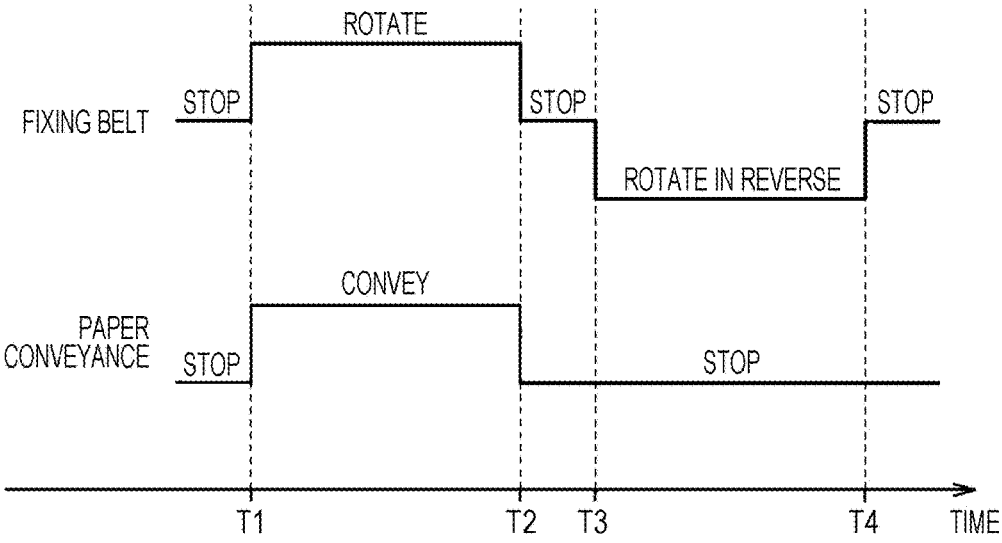
FIG. 11 is a timing chart illustrating rotation and reverse rotation of a fixing belt as well as conveyance of a sheet.

FIG. 11 is a timing chart illustrating rotation and reverse rotation of the fixing belt 54 as well as conveyance of a sheet S. The control unit 101 illustrated in FIG. 10 starts the rotation of the fixing belt 54 at time T1 to start conveying the sheet S. The control unit 101 moves the fixing belt 54 in the direction of conveyance when conveying the sheet S. The control unit 101 stops the rotation of the fixing belt 54 at time T2 to stop conveying the sheet S.

After the conveyance of the sheet S is stopped, the control unit 101 starts the reverse rotation of the fixing belt 54 at time T3. After moving the fixing belt 54 in the direction opposite to the direction of conveyance for a predetermined period of time, the control unit 101 stops the reverse rotation of the fixing belt 54 at time T4. The duration (from time T3 to time T4) for which the control unit 101 rotates the fixing belt 54 in the reverse direction is set on the basis of conditions at the time of moving the fixing belt 54 in the direction of conveyance.

Figure 12:
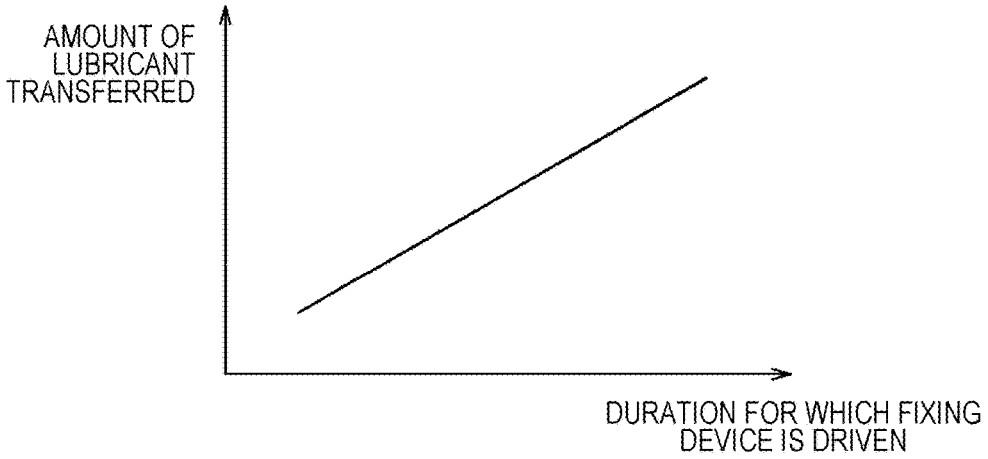
FIG. 12 is a graph illustrating a relationship between duration for which the fixing device is driven and the amount of a lubricant being transferred.

FIG. 12 is a graph illustrating a relationship between duration for which the fixing device 50 is driven and the amount of the lubricant 68 being transferred. As illustrated in FIG. 12, the longer the fixing device 50 is driven to fix a toner image 32 (FIG. 2) to the sheet S, the larger the amount of the lubricant 68 transferred to the downstream side in the direction of conveyance. Therefore, the duration for which the fixing belt 54 is rotated in the reverse direction is extended. The amount of the lubricant 68 transferred to the downstream side in the direction of conveyance is reduced as the fixing device 50 is driven for shorter duration, which shortens the duration for which the fixing belt 54 is rotated in the reverse direction.

Figure 13:
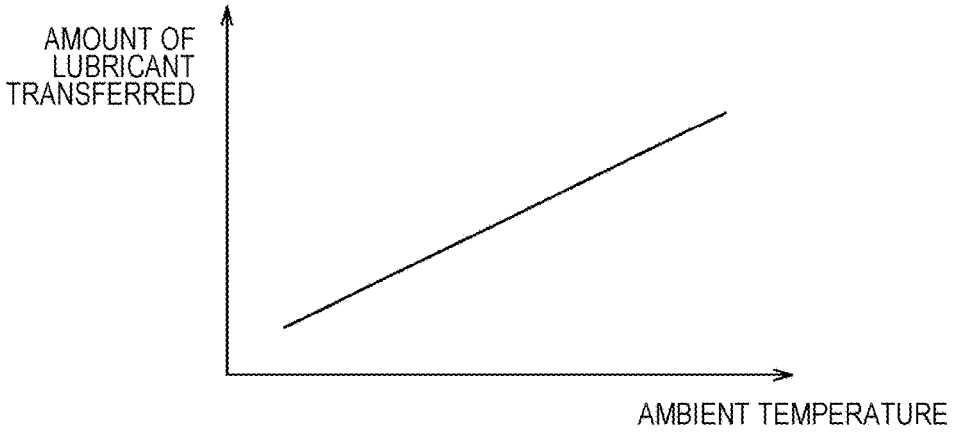
FIG. 13 is a graph illustrating a relationship between ambient temperature and the amount of the lubricant being transferred.

FIG. 13 is a graph illustrating a relationship between ambient temperature and the amount of the lubricant 68 being transferred. As illustrated in FIG. 13, the viscosity of the lubricant 68 is lower as the ambient temperature is higher while the fixing device 50 is driven to fix the toner image 32 (FIG. 2) to the sheet S, in which case the lubricant 68 moves more readily to result in an increased amount of the lubricant 68 being transferred to the downstream side in the direction of conveyance. Therefore, the duration for which the fixing belt 54 is rotated in the reverse direction is extended. The viscosity of the lubricant 68 is higher as the ambient temperature is lower while the fixing device 50 is driven, in which case the lubricant 68 moves less readily to result in a decreased amount of the lubricant 68 being transferred to the downstream side in the direction of conveyance and reduced duration for which the fixing belt 54 is rotated in the reverse direction.

In addition to the examples illustrated in FIGS. 12 and 13, when the lubricant is left standing for a long time before the fixing device 50 is driven, the lubricant 68 has high viscosity and is transferred less to the downstream side in the direction of conveyance, whereby the duration for which the fixing belt 54 is rotated in the reverse direction is shortened. When the temperature of a nip region is set low according to the type of the sheet S, the amount of the lubricant 68 being transferred to the downstream side in the direction of conveyance is decreased to shorten the duration for which the fixing belt 54 is rotated in the reverse direction.

As described in the example above, the during for which the fixing belt 54 is rotated in the reverse direction is properly set on the basis of the conditions at the time of moving the fixing belt 54 in the direction of conveyance. The life of the fixing device 50 can be extended by minimizing the duration for which the fixing belt 54 is rotated in the reverse direction and inhibiting the increase in the duration for which the fixing belt 54 is rotated.

Although the present invention has been described and illustrated in detail, it is clearly understood that the same is by way of illustrated and example only and is not to be taken by way of limitation, the scope of the present invention being interpreted by terms of the appended claims. The scope of the present invention is intended to include meanings equivalent to the scope of the claims and all modifications within the scope of the claims.

What is claimed is:

1. A fixing device for fixing a toner image onto a recording medium, the device comprising:

an endless belt that is configured to be able to rotate;

a pressure member that is in contact with an outer peripheral surface of the belt; and a sliding member that has a sliding surface in contact with an inner peripheral surface of the belt and is arranged to face the pressure member with the belt interposed between the sliding member and the pressure member, wherein a direction in which the belt rotating at the time of conveying the recording medium slides on the sliding surface is referred to as a direction of conveyance, a plurality of first grooves each extending in a direction intersecting with the direction of conveyance as well as a plurality of second grooves each allowing two of the plurality of first grooves adjacent to each other to communicate with each other are formed on the sliding surface, and the first grooves and the second grooves are formed in a non-grid pattern.

2. The fixing device according to claim 1, wherein at least one of a width of the second groove, a depth of the second groove and spacing between the second grooves varies between a center and an edge of the sliding surface in an orthogonal direction orthogonal to the direction of conveyance.

3. The fixing device according to claim 2, wherein the second groove formed on the edge of the sliding surface in the orthogonal direction is wider, deeper or has narrower spacing than the second groove formed at the center of the sliding surface in the orthogonal direction.

4. The fixing device according to claim 1, wherein the second groove is formed in a non-linear shape.

5. The fixing device according to claim 1, wherein a position at which the second groove communicates with the first groove on an upstream side in the direction of conveyance and a position at which the second groove communicates with the first groove on a downstream side in the direction of conveyance are shifted from each other in a direction in which the first groove extends.

6. The fixing device according to claim 1, wherein at least one of a width of the first groove, a depth of the first groove and spacing between the first grooves varies between an upstream side and a downstream side in the direction of conveyance.

7. The fixing device according to claim 6, wherein the first groove formed on the downstream side of the direction of conveyance is wider, deeper or has narrower spacing than the first groove formed on the upstream side of the direction of conveyance.

8. The fixing device according to claim 1, wherein the first groove is formed on an edge of the sliding surface in the direction of conveyance at a center of the sliding surface in an orthogonal direction orthogonal to the direction of conveyance, and is formed away from the edge of the sliding surface in the direction of conveyance on an edge of the sliding surface in the orthogonal direction.

9. The fixing device according to claim 1, wherein each of two ends of the first groove is arranged at a position away from the edge of the sliding surface.

10. The fixing device according to claim 1, wherein the direction of conveyance corresponds to a vertically upward direction.

11. The fixing device according to claim 1, wherein the belt can move in both the direction of conveyance and a direction opposite to the direction of conveyance selectively with respect to the sliding surface.

12. The fixing device according to claim 11, further comprising a processor configured to control an operation of the fixing device, wherein the processor moves the belt in the direction of conveyance at the time of conveying the recording medium and, after stopping conveyance of the recording medium, moves the belt in the opposite direction on the basis of conditions at the time of moving the belt in the direction of conveyance.

13. The fixing device according to claim 1, wherein each of the first groove and the second groove has a width of 5 μm or larger and 500 μm or smaller and a depth of 50 μm or larger and 100 μm or smaller.

14. An image forming apparatus comprising the fixing device according to claim 1.

15. A fixing device for fixing a toner image onto a recording medium, the device comprising:

an endless belt that is configured to be able to rotate;

a pressure member that is in contact with an outer peripheral surface of the belt; and a sliding member that has a sliding surface in contact with an inner peripheral surface of the belt and is arranged to face the pressure member with the belt interposed between the sliding member and the pressure member, wherein a direction in which the belt rotating at the time of conveying the recording medium slides on the sliding surface is referred to as a direction of conveyance, while a direction orthogonal to the direction of conveyance is referred to as an orthogonal direction, a plurality of grooves each extending in a direction intersecting with the direction of conveyance is formed on the sliding surface, and a groove is formed to extend along the orthogonal direction at a point equidistant from side edges of the sliding member, extend in a first direction other than the orthogonal direction from the equidistant point toward a first side edge of the sliding member, and extend in a second direction other than the orthogonal direction from the equidistant point toward a second side edge of the sliding member opposite the first side edge.

* * * * *